US010173261B2

(12) United States Patent
Slavens et al.

(10) Patent No.: US 10,173,261 B2
(45) **Date of Patent: *Jan. 8, 2019**

(54) HIGHLY COOLED DIE CASTING PLUNGER

(71) Applicant: United Technologies Corporation, Hartford, CT (US)

(72) Inventors: Thomas N. Slavens, Moodus, CT (US); Carl R. Verner, Windsor, CT (US); Albert Rabinovich, West Hartford, CT (US); Weiduo Yu, Southington, CT (US); Awadh B. Pandey, Jupiter, FL (US)

(73) Assignee: United Technologies Corporation, Farmington, CT (US)

( * ) Notice: Subject to any disclaimer, the term of this patent is extended or adjusted under 35 U.S.C. 154(b) by 125 days.

This patent is subject to a terminal disclaimer.

(21) Appl. No.: 14/949,285

(22) Filed: Nov. 23, 2015

(65) Prior Publication Data

US 2017/0136532 A1 May 18, 2017

Related U.S. Application Data

(63) Continuation-in-part of application No. 14/943,787, filed on Nov. 17, 2015.

(51) Int. Cl.
*B22D 17/20* (2006.01)

(52) U.S. Cl.
CPC ..... *B22D 17/2038* (2013.01); *B22D 17/203* (2013.01)

(58) Field of Classification Search
CPC ..... B22D 17/203; B22D 17/2038
See application file for complete search history.

(56) References Cited

U.S. PATENT DOCUMENTS

| | | | |
|---|---|---|---|
| 4,334,575 | A | 6/1982 | Miki et al. |
| 4,534,403 | A | 8/1985 | Harvill |
| 4,598,762 | A | 7/1986 | Glas |
| 4,886,107 | A | 12/1989 | Zecman |
| 5,246,055 | A | 9/1993 | Fields et al. |
| 6,871,691 | B2 | 3/2005 | Nakao et al. |

(Continued)

FOREIGN PATENT DOCUMENTS

| | | | |
|---|---|---|---|
| EP | 0418839 | A1 | 3/1991 |
| EP | 3170581 | A1 | 5/2017 |

(Continued)

OTHER PUBLICATIONS

Extended European Search Report for EP Application No. 16199445.4, dated Mar. 24, 2017, 10 pages.

(Continued)

*Primary Examiner* — Kevin E Yoon
*Assistant Examiner* — Jacky Yuen
(74) *Attorney, Agent, or Firm* — Kinney & Lange, P.A.

(57) ABSTRACT

A die casting plunger tip includes a hollow outer portion and a hollow inner portion. The outer portion has a first closed end. The inner portion has a second partially closed end. The inner portion is disposed within the outer portion and the second partially closed end is adjacent the first closed end of the outer portion in an axial direction. A plurality of connectors connects the outer portion and the inner portion. A plenum is formed between the outer portion and the inner portion.

20 Claims, 7 Drawing Sheets

(56) References Cited

U.S. PATENT DOCUMENTS

| | | | | |
|---|---|---|---|---|
| 2001/0009186 | A1 | 7/2001 | Perrella et al. | |
| 2009/0139683 | A1* | 6/2009 | Muller | B22D 17/203 164/312 |
| 2012/0111524 | A1* | 5/2012 | Schlichting | B22D 17/203 164/113 |
| 2013/0277004 | A1 | 10/2013 | Chow | |
| 2014/0262111 | A1* | 9/2014 | Stevick | B22D 17/203 164/113 |

FOREIGN PATENT DOCUMENTS

| | | | | |
|---|---|---|---|---|
| JP | H0732114 | A | | 2/1995 |
| JP | 09174218 | A | * | 7/1997 |
| JP | H09174218 | A | | 7/1997 |
| JP | H11239857 | A | | 9/1999 |
| JP | 2004134607 | A | | 4/2004 |
| KR | 20020045177 | A | | 6/2002 |
| KR | 20110001470 | A | * | 1/2011 |

OTHER PUBLICATIONS

Extended European Search Report for EP Application No. 16199295.3, dated Apr. 6, 2017, 8 pages.

Communication Pursuant to Article 94(3) EPC for EP Application No. 16199445.4, dated Aug. 9, 2018, 6 pages.

* cited by examiner

HIGHLY COOLED DIE CASTING PLUNGER

BACKGROUND

The present application relates generally to methods and apparatuses for die casting, and more specifically to die casting plunger tips and methods used for casting high temperature alloy components.

Die casting is a metal casting process, which involves injecting a molten metal into a mold or multi-part die to form a component. The die casting process is commonly used for the manufacture of various metal components. A number of die casting apparatuses, generally tailored to low temperature metal solutions such as aluminum, zinc, and magnesium, are known in the art. These die casting apparatuses use a plunger or piston to force molten metal through a shot tube into a mold. A tip of the plunger serves to force the molten metal into the mold, while also forming a seal within the shot tube to prevent backflow of the molten metal around the plunger. Forming a seal necessitates that a gap between the plunger tip and the shot tube be controlled to a very small clearance. Because a high heat load associated with the molten metal can cause thermal expansion of the plunger tip and shot tube, a coolant is supplied to the plunger tip to limit thermal expansion of the plunger tip and limit radial binding of the plunger tip within the shot tube. The plunger tip is typically water cooled with water being supplied to a backside of the tip and evacuated through an annular jacket. Various configurations are tailored to low temperature melt solutions (e.g., generally around or below 1500° F. (815° C.)) and are not effective for managing higher heat loads such as exist in the casting of superalloys, which generally involve temperatures above 2500° F. (1371° C.). In addition to providing ineffective thermal management for high heat loads, high thermal stresses may limit long-term durability of the plunger tips, and thus these configurations may not work for the casting of superalloys.

A plunger tip or plunger tip assembly is needed for die casting of superalloy components, which can allow for improved thermal management, including better control of radial deflection (expansion and contraction) of a tip under high transient thermal load, and which can extend long-term durability of the plunger tip.

SUMMARY

In one embodiment of the present invention, a die casting plunger tip includes a hollow outer portion and a hollow inner portion. The outer portion has a first closed end. The inner portion has a second partially closed end. The inner portion is disposed within the outer portion and the second partially closed end is adjacent the first closed end of the outer portion in an axial direction. A plurality of connectors connects the outer portion and the inner portion. A plenum is formed between the outer portion and the inner portion In another embodiment of the present invention, a method of using convection cooling to cool walls of a double-walled die casting tip and using conduction cooling to cool an outer hollow portion of the double-walled die casting tip. The use of convection cooling can include the steps of supplying a cooling fluid to a central cavity of a hollow inner portion, supplying the cooling fluid to a first portion of a plenum located between a first closed end of a hollow outer portion and a second partially closed end of the inner portion, and supplying the cooling fluid to a second portion of the plenum located between the outer portion and the inner portion along an axial length of the inner portion. Use of conduction cooling to cool the outer portion can include transferring heat through a third connector connecting the first closed end and second partially closed end and located in the first portion of the plenum.

The present summary is provided only by way of example, and not limitation. Other aspects of the present disclosure will be appreciated in view of the entirety of the present disclosure, including the entire text, claims and accompanying figures.

Figure 1:
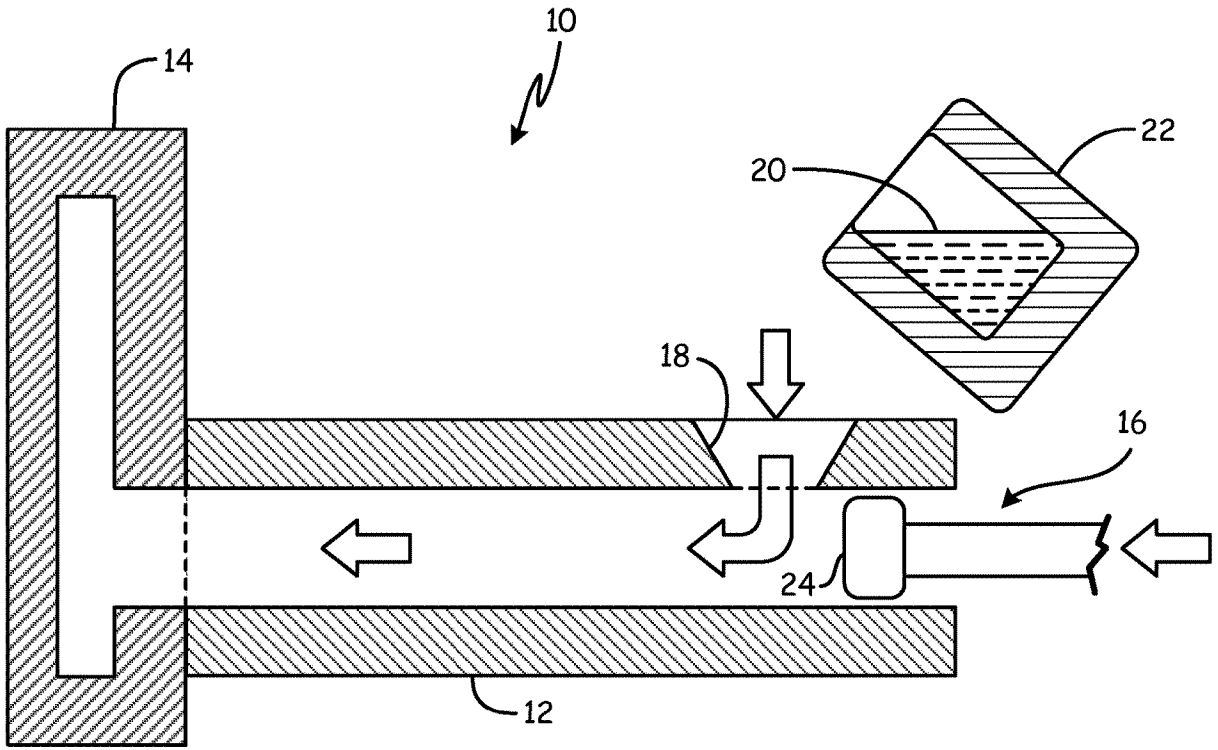
FIG. 1 is a simplified cross-sectional view of a die casting apparatus.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

A highly cooled die casting plunger utilizing back-side tip convection/conduction cooling in combination with a double-walled tip and a disposable tip shield to reduce thermal stresses on the tip can be used in a die casting process for alloys with an incipient melt temperature above 2000° F. (1093° C.). The use of a double-walled tip, for back-side tip convection/conduction cooling, and/or a tip shield can effectively keep a die casting plunger tip at near-constant radial dimension during the die casting process, thereby limiting the potential for jamming due to thermal expansion.

FIG. 1 is a simplified cross-sectional view of die casting apparatus 10. Die casting apparatus 10 can include shot tube 12, casting mold 14, and plunger 16. Shot tube 12 can be integrally connected with a portion of casting mold 14 or can be removably attached to casting mold 14, as known in the art. Shot tube 12 can include inlet 18, which opens into a central cavity in shot tube 12. Molten metal 20 can be poured from crucible 22 through inlet 18 into the central cavity of shot tube 12. Plunger 16 can be used to force molten metal 20 through the central cavity of shot tube 12 into casting mold 14. Plunger tip assembly 24 can reduce a potential for or prevent backflow of molten metal 20 around plunger 16.

Shot tube 12, casting mold 14, and plunger 16 can each be comprised of a high-strength superalloy with high incipient melt temperature, such as, but not limited to a high temperature nickel-based alloy or cobalt-based alloy. In some embodiments, shot tube 12, casting mold 14, and plunger 16 need not each be comprised of the same material. Generally, materials can be selected by matching expansion coefficients and wear characteristics of plunger tip assembly 24 and shot tube 12 to limit wear of the components. Other materials, as known in the art, may be used for casting components made of materials with lower incipient melt temperatures, such as aluminum, zinc, and magnesium.

Figure 2:
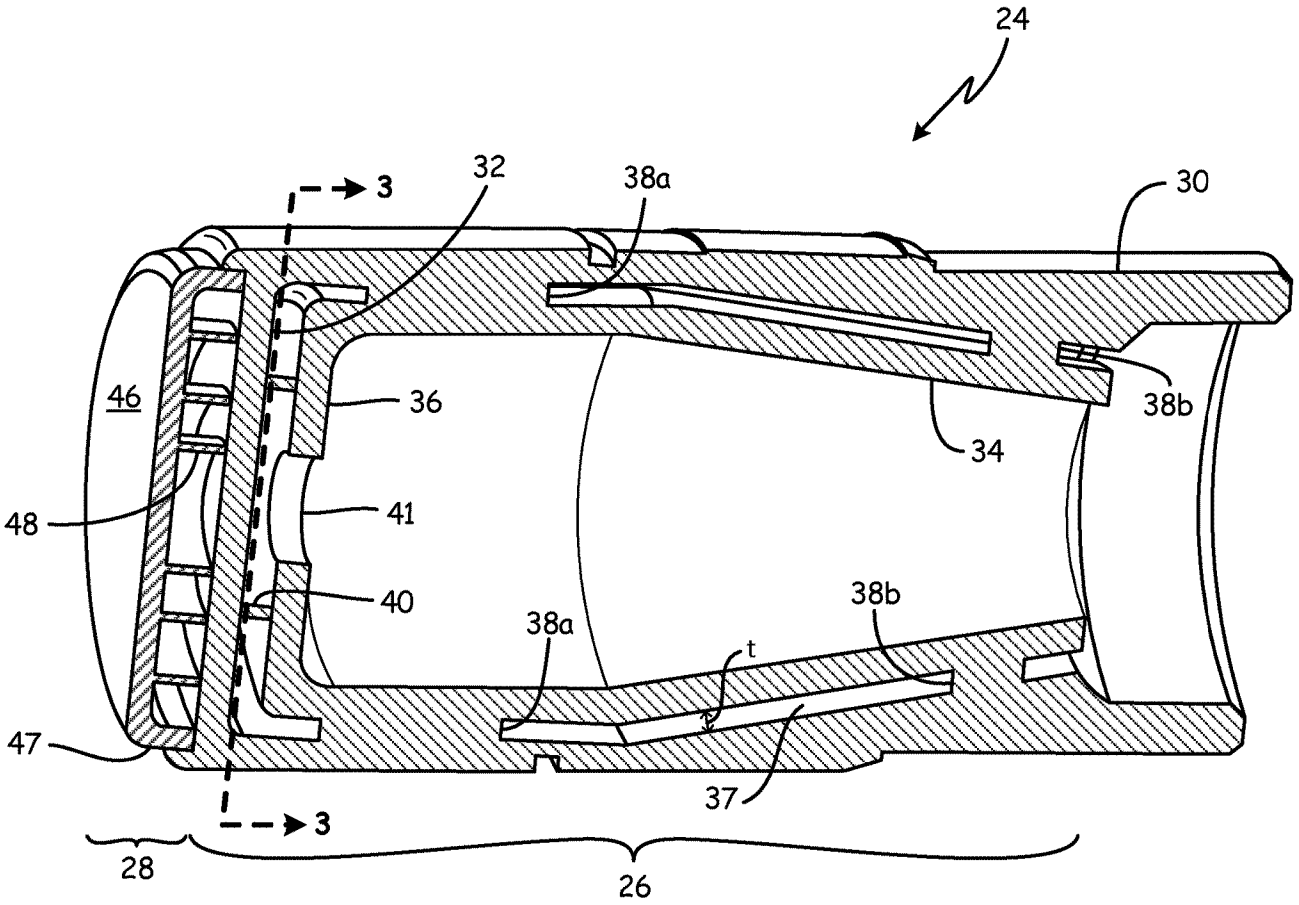
FIG. 2 is a perspective cross-sectional view of one embodiment of a highly cooled die casting plunger tip assembly.

FIG. 2 is a perspective cross-sectional view of one embodiment of plunger tip assembly 24. Plunger tip assembly 24 can include tip 26 and an optional tip cover 28. Tip 26 can include outer portion 30 with closed end 32 and inner portion 34 with partially closed end 36. Outer portion 30 and inner portion 34 can be hollow. Inner portion 34 can be a fluid supply portion. Outer portion 30 can be a fluid evacuation portion. Inner portion 34 can be disposed within outer portion 30, substantially separated by cooling fluid plenum 37 disposed around inner portion 34 and between closed end 32 and partially closed end 36. Outer portion 30 and inner portion 34 can be substantially annular. Generally, outer portion 30 can have an outer surface shaped to match an inner surface of shot tube 12 (not shown) to effectively form a seal between outer portion 30 and shot tube 12 during the die casting process. A shape of inner portion 34 can differ from the shape of outer portion 30. The shape of inner portion 34 can be optimized for thermal management of tip 26.

Outer portion 30 and inner portion 34 can be integrally and monolithically formed using additive manufacturing or other techniques known in the art, and can be integrally connected by one or more connectors or ribs 38*a*, 38*b*, 40. Alternatively, outer portion 30 and inner portion 34 can be manufactured separately and connected to form a single body. Outer portion 30, including closed end 32, can have a thin wall with wall thicknesses generally ranging from 1.27 mm (0.05 inches) to 4.47 mm (0.175 inches). Inner portion 34, including partially closed end 36, can have a wall thickness substantially equal to, greater than, or less than the wall thickness of outer portion 30. Inner portion 34 can effectively serve as a conduction heat sink for heat conducted from optional tip cover 28 and closed end 32 and outer portion 30. In some areas where a heat sink can be most beneficial, inner portion 34 can have a wall thickness up to three times greater than the wall thickness of outer portion 30. Generally the wall thickness of inner portion 34 can be greater at or near partially closed end 36 where heat transfer can be greatest.

Cooling fluid plenum 37 can carry a cooling fluid to provide convection cooling for tip 26. A volume of cooling fluid plenum 37 can be set by the size and number of connectors 38*a*, 38*b*, and 40 disposed between and connecting outer portion 30 and inner portion 34. Support structure 40 can be configured to optimize the volume of a first portion of cooling fluid plenum 37 disposed between closed end 32 and partially closed end 36, while connectors 38*a* and 38*b* can be configured to optimize the volume of a second portion of cooling fluid plenum 37 disposed along the axial length of tip 26 or inner portion 34. In some embodiments, cooling fluid plenum 37 can have a thickness t (measured as a distance between an inner surface of outer portion 30 and an outer surface of inner portion 34, including along the axial length of tip 26 and at closed end 32 and partially closed end 36) substantially equal to or less than the wall thickness of inner portion 34. Further, a distance between outer and inner portions 30 and 34 can be greater at the respective closed end 32 and partially closed end 36 than along the axial length of tip 26. For instance, in a non-limiting embodiment, the distance between closed end 32 and partially closed end 36, forming plenum 37, can be approximately 2.75 mm; whereas the distance between portions 30 and 34 along the axial length of tip 26 can be approximately 1.75 mm. Providing a relatively low volume cooling fluid plenum 37 can increase flow through cooling fluid plenum 37 and convection cooling to tip 26. As further discussed below, the volume of cooling fluid plenum 37 can be configured as necessary to optimize convection cooling.

Connectors 38*a* and 38*b* can connect inner portion 34 and outer portion 30. Connectors 38*a* and 38*b* can be disposed along an axial length of inner portion 34. Generally, a plurality of first and second connectors 38*a* can be disposed around a perimeter or outer surface of inner portion 34. First connectors 38*a* can be disposed near partially closed end 36. Second connectors 38*b* can be disposed along an axial length of inner portion 34 at a distance from first connectors 38*a*. In one embodiment, around five to six of each of first and second connectors 38*a* and 38*b* can be disposed around the outer surface of inner portion 34. In a non-limiting embodiment, first and second connectors 38*a* and 38*b* cover approximately thirty percent of the axial length of the outer surface inner portion 34, with second connectors 38*b* having a length approximately 40 percent of a length of first connectors 38*a*. First and second connectors 38*a* and 38*b* can be located to maintain cooling fluid plenum 37 between outer portion 30 and inner portion 34 and to provide a conduction path for cooling outer portion 30. First and second connectors 38*a* and 38*b* can each be a substantially rectangular prism in shape, however, are not limited to the rectangular prism construction. In some embodiments, such as shown in FIG. 2, first connectors 38*a* can be longer in length than second connectors 38*b*, thereby providing an increased area for thermal conduction between outer portion 30 and inner portion 34 near a forward end of plunger tip assembly 24. It will be understood by one skilled in the art that connectors 38*a* and 38*b* can be modified in position, shape, and number as needed to provide structural support and thermal management of plunger tip assembly 24 and/or connection between outer portion 30 and inner portion 34.

One or more third connectors 40 can be disposed between closed end 32 and partially closed end 36. Connectors 40 can be used to provide structural support for the tip 26, maintain cooling fluid plenum 37 between closed end 32 and partially closed end 36, and provide a thermal conduction path between closed end 32 and partially closed end 36.

Figure 3:
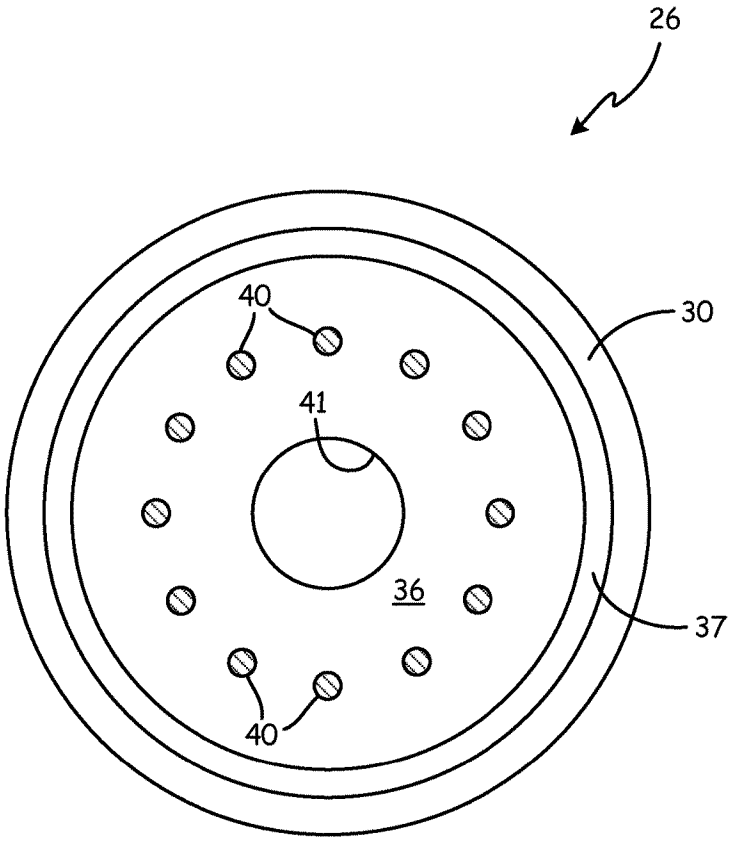
FIG. 3 is an elevation view of a portion of the highly cooled die casting plunger tip assembly taken along the line 3-3 of FIG. 2.

FIG. 3 is a cross-sectional view of a portion of plunger tip assembly 24 taken along the line 3-3 of FIG. 2. FIG. 3 shows outer portion 30, cooling fluid plenum 37, partially closed end 36 with cooling fluid hole 41 passing therethrough, and connectors 40. As shown in FIG. 3, connectors 40 can comprise cylindrical or pedestal-style supports placed circumferentially around cooling fluid hole 41. The size, shape, number, and positioning of connectors 40 can be modified as necessary to provide structural support and thermal management of plunger tip assembly 24.

Figure 4:
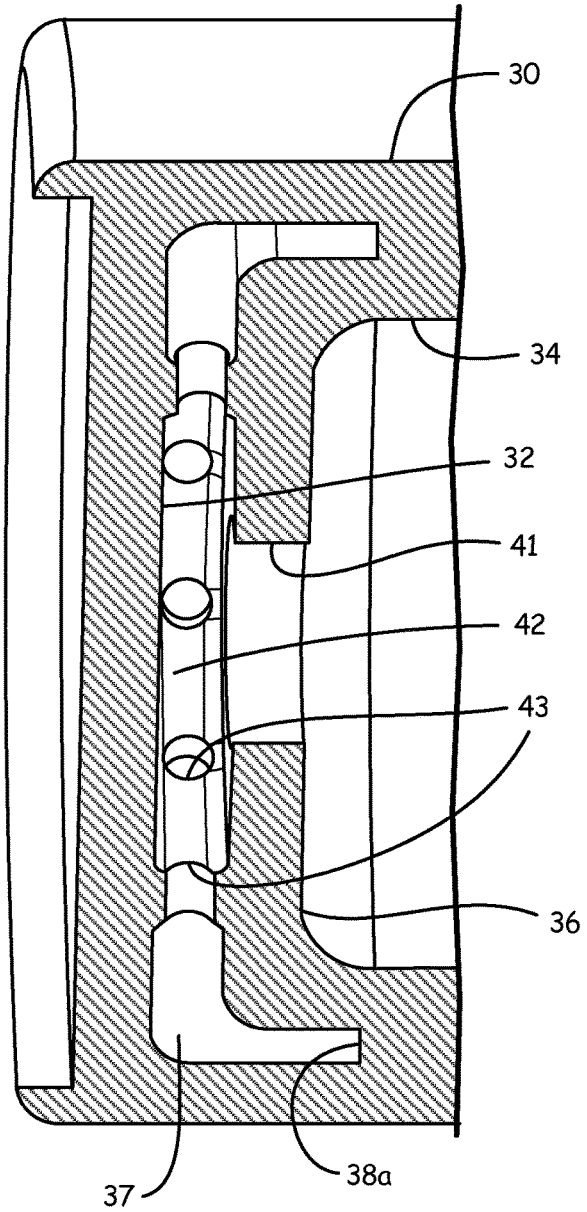
FIG. 4 is a cross-sectional view of a portion of another embodiment of a highly cooled die casting plunger.

FIG. 4 is a cross-sectional view of a portion of another embodiment of a die casting tip. FIG. 4 shows outer portion 30 and closed end 32, inner portion 34 and partially closed end 36 with cooling fluid hole 41 passing therethrough, and a third support structure 42, having a different construction than third connectors 40 shown in FIGS. 2 and 3. Support structure 42 can be a unitary structure extending between closed end 32 and partially closed end 36 and forming a ring around cooling fluid hole 41. Holes 43 can extend through support structure 42 to allow cooling fluid to pass through support structure 42. In one embodiment, six to eight holes 43 can be evenly spaced around support structure 42 with diameters substantially similar to a distance between closed end 32 and partially closed end 36. It will be understood by one skilled in the art that the number and size of holes as well as thickness of support structure 42 can be modified as necessary to optimize cooling fluid flow and thermal management of tip 26.

FIGS. 3 and 4 represent only two possible embodiments of connectors 40 and 42. It will be understood by one skilled in the art that connectors 40 and 42 are only two of many options suitable for providing support, providing a thermal conduction path, and maintaining a cooling fluid plenum within a tip of a plunger assembly.

Figure 5:
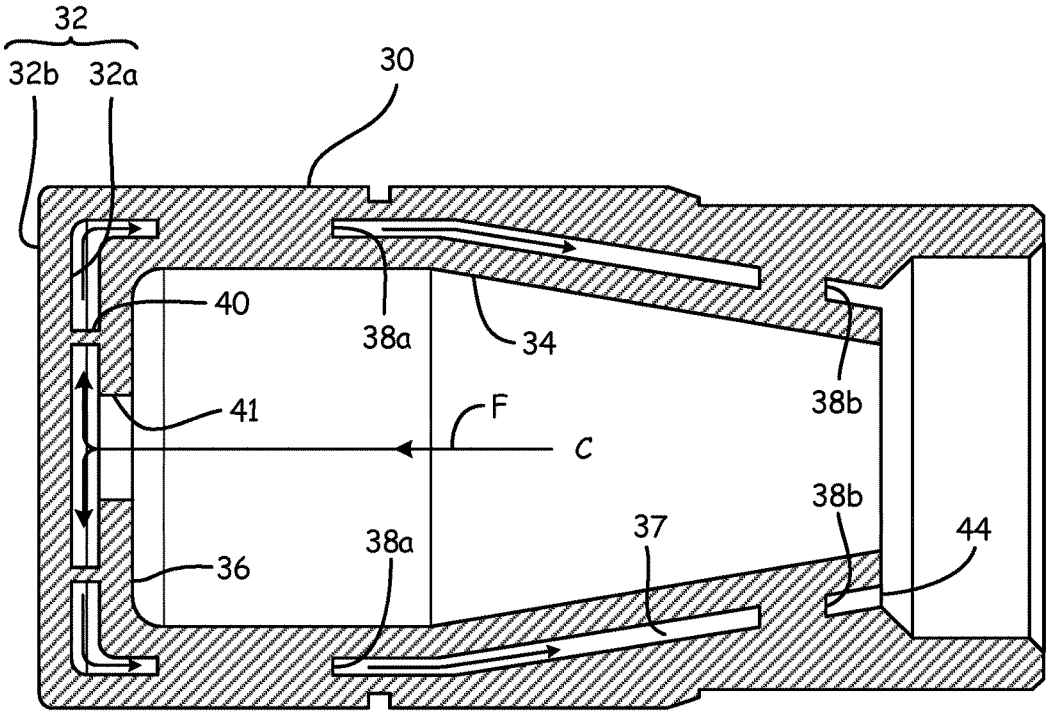
FIG. 5 is a cross-sectional view of a portion of the die casting plunger tip assembly of FIG. 2.

FIG. 5 is a cross-sectional view of a portion of the die casting plunger tip assembly of FIG. 2 absent optional tip cover 28. Convection cooling of tip 26 can be used to reduce thermal expansion during a die casting process due to exposure of plunger tip assembly 24 to molten metal 20. Cooling fluid can be supplied to a back side 32*a* of closed end 32 (opposite an outer surface 32*b* in contact with molten metal 20) and to cooling fluid plenum 37 disposed between inner portion 34 and outer portion 30. Cooling fluid can include water, gas or liquefied gas (e.g., air, inert gases, carbon dioxide, liquid nitrogen, etc.), or any other fluid suitable for thermal management of cooling tip 26. As indicated by flow arrows F, the cooling fluid can enter the central cavity C defined by inner portion 34 and flow through central hole 41 in partially closed end 36 into cooling fluid plenum 37 disposed between closed end 32 and partially closed end 36 and outer and inner portions 30 and 34. The cooling fluid can exit outer portion 30 at a back end 44. In some embodiments, for example, fluid velocities that produce a Reynolds number in the range of 200,000 to 1.5 million can be effective for thermal management of tip 26. Cooling fluid can be supplied through an open fluid circuit or closed fluid circuit having a mechanism for cooling the fluid. In some embodiments, an initial cooling fluid temperature can generally be around 70° F. (21° C.). As cooling fluid flows between outer portion 30 and inner portion 34, it effectively removes heat from plunger tip assembly 24.

As previously discussed, wall thicknesses of outer portion 30 and inner portion 34, including closed end 32 and partially closed end 36, and connectors 38*a*, 38*b*, and 40 (42), as well as plenum volume, can be configured as necessary for thermal management of tip 26. In addition, cooling fluid flow and temperature can each be optimized to keep outer portion 30 and inner portion 34 near an initial temperature (generally around 70° F. (21° C.)) during the die casting process. Modification of wall thickness, plenum volume, cooling fluid flow, and cooling fluid temperatures can help maintain tip 26 at a near-constant radial dimension and prevent or limit the potential for jamming. In some embodiments, a heat transfer coefficient between outer portion 30 and cooling fluid plenum 37 can be in the range of 300-2500 Btu/hour*ft$^2$*F when the cooling fluid is supplied to cooling fluid plenum 37. It will be understood by one skilled in the art that the cooling fluid temperature and flow, in addition to the volume of plenum 37 and wall thicknesses of outer portion 30 and closed end 32, inner portion 34 and partially closed end 36, and first, second, and third connectors 38*a*, 38*b*, and 40 (42), can be configured as necessary to maintain tip 26 at a near-constant radial dimension during the die casting process.

Figure 6:
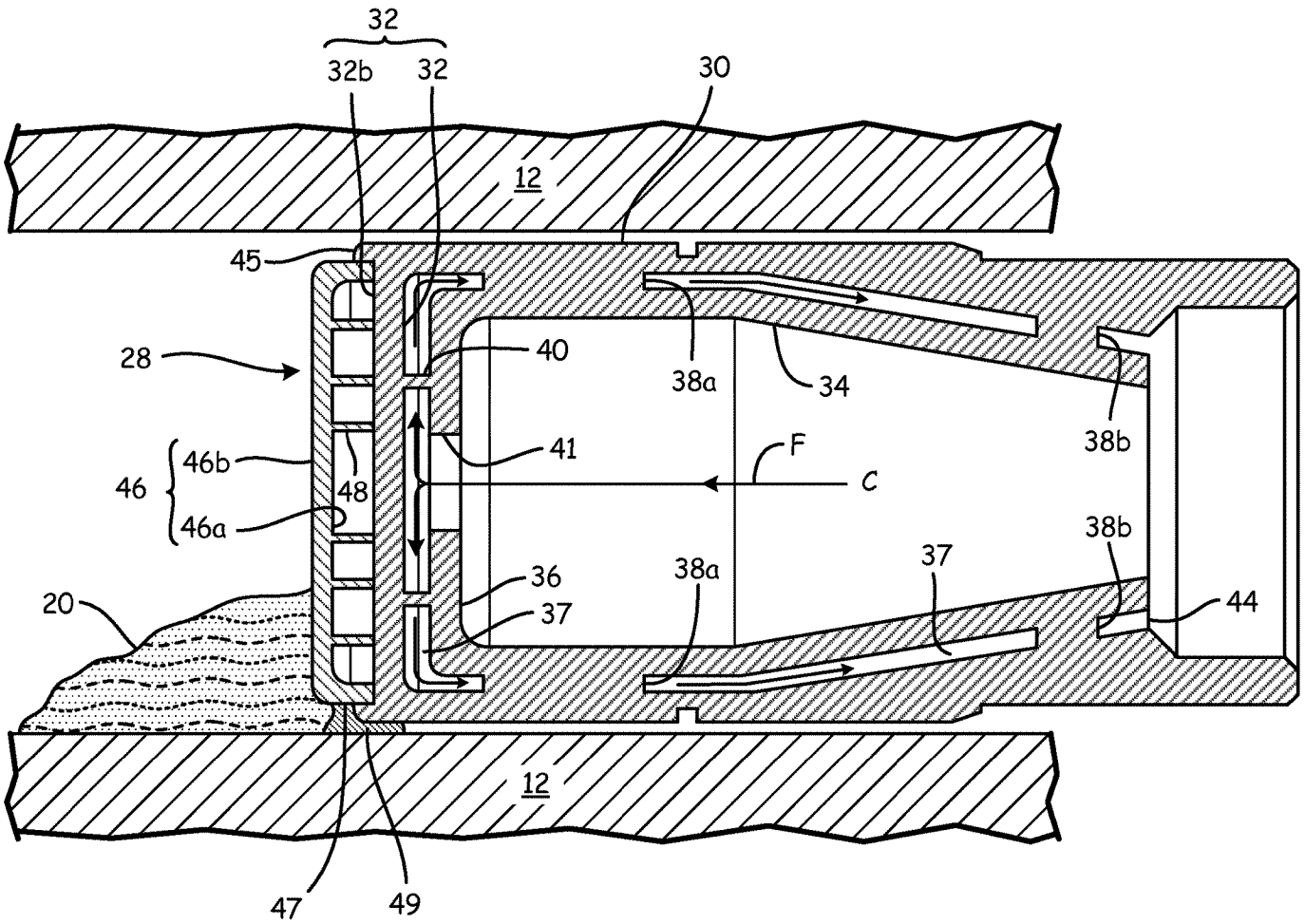
FIG. 6 is a cross-sectional view of a portion of the die casting apparatus of FIG. 1 and die casting plunger tip assembly of FIG. 2.

FIG. 6 is a cross-sectional view of a portion of the die casting apparatus of FIG. 1 and die casting plunger tip assembly of FIG. 2. An optional tip cover 28 can also reduce radial deflection caused by thermal expansion and contraction of tip 26 and help shield tip 26 from high thermal stresses. Tip cover 28 can be disposed on outer surface 32*b* of closed end 32 to shield a substantial portion (in some embodiments, greater than 85% of the surface area) of the tip 26 from making contact with molten metal 20. Tip cover 28 can be substantially circular, matching a shape of closed end 32 and can be disposed within an optional outer rim 45 of closed end 32. Outer rim 45 can extend from a perimeter of outer surface 32*b* of closed end 32 toward tip cover 28. An inner surface of outer rim 45 can engage an outer edge of tip cover 28. In some embodiments, during the die casting process, tip cover 28 can thermally expand to form a tight or interference fit within outer rim 45. Upon cooling, tip cover 28 can contract and release from outer rim 45 of closed end 32 when tip 26 is removed from die casting assembly 10. Tip cover 28 can adhere to the metal component during the die casting process, and separate from tip 26 when tip 26 is pulled back through shot tube 12. Tip cover 28 can be removed from the component during the die casting shake-out or trimming process and can be reapplied to tip 26 for reuse. In some embodiments, after multiple uses, the ability of tip cover 28 to shield tip 26 may be reduced and tip cover 28 can be disposed of and replaced. Alternatively, tip cover 28 can made of a material common to the metal component, such that tip cover 28 can be removed from the component in the trimming process and added to crucible 22 for melting and casting, i.e., tip cover 28 can be recycled. Utilizing thermal expansion of tip 28 for retention, as opposed to fixed retention features such as threaded interfaces, can simplify assembly and removal of tip 28. However, in some embodiments, tip 28 can be configured to removably and fixedly attach to tip 26, such as by threads, tooth-slot-joint, or other connection mechanisms.

Tip cover 28 can have a cap-like shape, having disk 46 with tip cover rim 47 extending from a perimeter of an inner surface 46*a* of disk 46 to engage closed end 32 upon assembly. As shown in FIG. 6, tip cover rim 47 can be disposed within outer rim 45 of tip 26 and positioned in contact with closed end 32 of tip 26. Tip cover rim 47 can cause disk 46 of tip cover 28 to be displaced from closed end 32, creating a one or more air plenums between closed end 32 and the inner surface 46*a* of tip cover 28. Tip cover 28 can include one or more support structures 48 extending from the inner surface 46*a* of disk 46. Support structures 48 can help stiffen tip cover 28, and can optionally contact closed end 32 of tip 26 to provide structural support and/or conductive heat transfer. Outer rim 45 of tip 26 can have an axial length less than rim 47 of tip cover 28, such that tip cover 28 extends outward from tip outer rim 45. Further rim 47 of the tip cover 28 can have a diameter less than tip outer rim 45, such that tip outer rim 45 is exposed to molten metal 20 during the die casting process. Because outer rim 45 of tip 26 can be highly cooled by cooling fluid circulating through tip 26, molten metal 20 can more quickly solidify at tip outer rim 45 than outer surface 46*b* of tip cover 28, which is displaced from the cooling fluid. As shown in FIG. 5, solidified metal 49 in the area of outer rim 45 can form a seal between shot tube 12 and tip 26 to limit backflow of molten metal 20 along a length of tip 26 in shot tube 12. Like tip cover 28, the solidified metal 49 can also shield tip 26 from molten metal 20.

Figure 7:
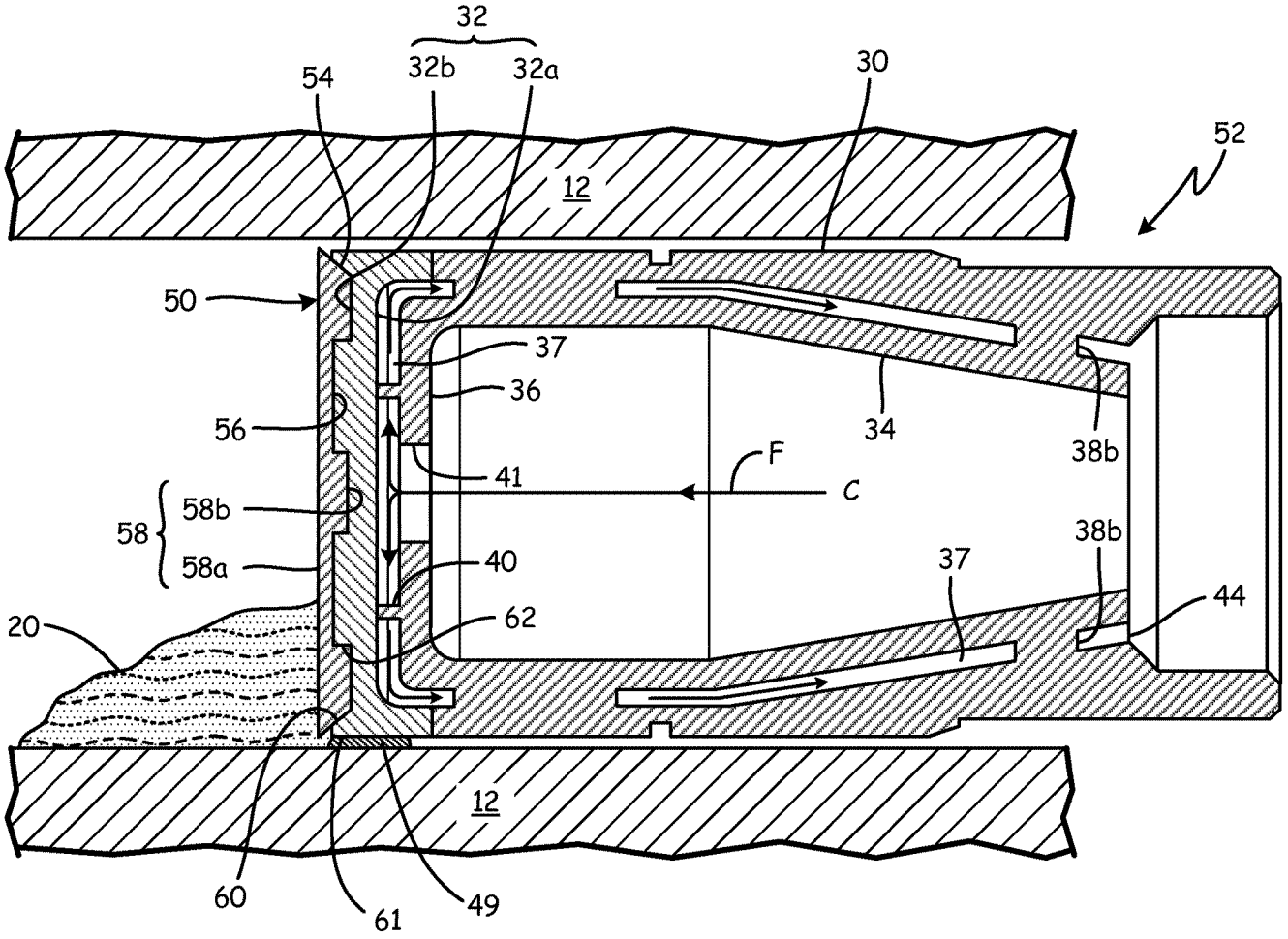
FIG. 7 is a cross-sectional view of a portion of another embodiment of a die casting plunger tip assembly and die casting apparatus.

FIG. 7 illustrates another embodiment of an optional tip cover for a plunger tip assembly. FIG. 7 is a cross-sectional view of plunger tip assembly 52. As shown in FIG. 7, tip cover 50 can have a disk-like shape with a chamfered outer edge 54 and a plurality of slots 56. Outer edge 54 of tip cover 50 can taper inward from outer surface 58*a* to inner surface 58*b* of tip cover 50. The chamfered shape of outer edge 54 can substantially match a chamfered inner surface 60 of outer rim 61 on closed end 32. As such, tip cover 50 can be disposed within outer rim 61 of closed end 32 of tip 26. Similar to the embodiment shown in FIG. 5, tip cover 50 can be disposed on closed end 32 to shield a substantial portion of the tip 26 from making contact with molten metal 20 and thereby help control the radial deflection of tip 26 due to thermal expansion and contraction. In some embodiments, outer rim 61 of closed end 32 can loosely engage tip cover 50 thereby allowing for thermal expansion of tip cover 50 during the die casting process. Like tip cover 28, tip cover 50 can also be reusable, disposable, or consumable.

Tip cover 50 can include a plurality of slots 56, which can extend through a partial thickness of tip cover 50, opening to tip cover inner surface 58*b*. As shown in FIG. 7, slots 56 can be disposed radially from a center of tip cover inner surface 58*b* and spaced apart from the center and the outer edge 54 of tip cover inner surface 58*b*. In the embodiment shown in FIG. 7, closed end 32 can have a plurality of protrusions 62 extending from tip outer surface 32*b* toward tip cover 50 when assembled. Protrusions 62 can substantially match slots 56 in shape and position such that protrusions 62 can be inserted into slots 56 upon assembly. A depth of slots 56 (measured as a distance to which slots extend into disk 58 from disk inner surface 58*b*) and length of protrusions 62 (measured as a distance to which protrusions extend outward from outer surface 32*a* of closed end 32) can be set to allow tip cover inner surface 58*b* to contact closed end 32 and create a plenum between each protrusion 62 and slot 56 upon assembly. Inner surface 60 provides structural support for tip cover 50 and a cooling conduction path, while the plurality of plenums created between protrusions 62 and slots 56 create a break in thermal conductivity thereby limiting heat transfer to closed end 32. It will be understood by one skilled in the art that the shape, number, and position of slots 56 and protrusions 62 can be modified, while still providing structural support and thermal management.

Unlike tip cover 28, shown in FIGS. 2 and 4, tip cover 50 has an outer diameter on outer surface 58 substantially equal to a maximum outer diameter of outer portion 30 (and tip outer rim 61). A small radial clearance between tip cover 50 and shot tube 12 can limit backflow of molten metal 20 along tip assembly 52 during the die casting process. Highly convective thermal cooling of closed end 32 can draw heat from tip cover 50 to limit the potential for thermal expansion of tip cover 50 and thereby control the radial clearance between tip cover 50 and shot tube 12. In some embodiments, tip cover 50 may be employed in die casting processes of short duration (e.g., 3 seconds).

Highly cooled die casting plunger tip assembly 16, utilizing back-side tip convection/conduction cooling in combination with double-walled tip 26 can reduce thermal stresses on tip 26 and can effectively be used in a die casting process for alloys with an incipient melt temperature above 2000° F. (1093° C.). The combined use the double-walled tip 26 for back-side tip convection/conduction cooling and a tip cover 28, 50, and variations thereon, can effectively keep die casting plunger tip 26 at near-constant radial dimension during the die casting process, thereby limiting the potential for jamming due to thermal expansion.

The following are non-exclusive descriptions of possible embodiments of the present invention.

A die casting plunger tip includes a hollow outer portion and a hollow inner portion. The outer portion has a first closed end. The inner portion has a second partially closed end. The inner portion is disposed within the outer portion and the second partially closed end is adjacent the first closed end of the outer portion in an axial direction. A plurality of connectors connect the outer portion and the inner portion. A plenum is formed between the outer portion and the inner portion.

The die casting plunger tip of the preceding paragraph can optionally include, additionally and/or alternatively, any one or more of the following features, configurations and/or additional components:

A further embodiment of the die casting plunger tip assembly, wherein the plurality of connectors can be disposed circumferentially about an outer surface of the inner portion and extend to an inner surface of the outer portion.

A further embodiment of any of the foregoing die casting plunger tips, wherein the plurality of connectors can include a plurality of first connectors and a plurality of second connectors. The second connectors can be disposed at a distance from the first connectors along the outer surface of the inner portion.

A further embodiment of any of the foregoing die casting plunger tips can include a third connector connecting the first closed end of the outer portion and the second partially closed end of the inner portion.

A further embodiment of any of the foregoing die casting plunger tips, wherein the third connector can include a plurality connector structures.

A further embodiment of any of the foregoing die casting plunger tips, wherein the third connector can include a plurality of holes.

A further embodiment of any of the foregoing die casting plunger tips, wherein the second partially closed end of the inner portion can include a central hole, which can connect a central cavity in the inner portion with the plenum formed between the outer portion and the inner portion.

A further embodiment of any of the foregoing die casting plunger tips, wherein the outer portion can have a wall thickness of between 1.27 mm (0.050 inches) and 4.45 mm (0.175 inches).

A further embodiment of any of the foregoing die casting plunger tips, wherein the outer portion can have a first wall thickness at the first closed end and the inner portion can have a second wall thickness at the second partially closed end. The second wall thickness can be substantially equal to or greater than the first wall thickness.

A further embodiment of any of the foregoing die casting plunger tips, wherein the outer portion and the inner portion can be separated along an axial length of the tip at a first distance and between the first closed end and second partially closed end at a second distance. The second distance can be greater than the first distance.

A further embodiment of any of the foregoing die casting plunger tips, wherein a heat transfer coefficient between the outer portion and a cooling fluid in the plenum can be in the range of 300-2500 Btu/hour*ft$^2$*F.

A further embodiment of any of the foregoing die casting plunger tips can include a tip cover disposed on the first closed end of the outer portion. A portion of the tip cover can be separated from the first closed end, creating one or more cavities between the tip cover and the first closed end.

A further embodiment of any of the foregoing die casting plunger tips, wherein the outer portion includes a rim disposed along a perimeter of an extending outward from the first closed end. An inner perimeter of the rim can engage an outer edge of the tip cover.

A method of cooling a die casting tip can include the steps of using convection cooling to cool walls of a double-walled die casting tip and using conduction cooling to cool an outer hollow portion of the double-walled die casting tip. The use of convection cooling can include the steps of supplying a cooling fluid to a central cavity of a hollow inner portion, supplying the cooling fluid to a first portion of a plenum located between a first closed end of a hollow outer portion and a second partially closed end of the inner portion, and supplying the cooling fluid to a second portion of the plenum located between the outer portion and the inner portion along an axial length of the inner portion. Use of conduction cooling to cool the outer portion can include transferring heat through a third connector connecting the first closed end and second partially closed end and located in the first portion of the plenum.

The method of the preceding paragraph can optionally include, additionally and/or alternatively, any one or more of the following features, configurations and/or additional steps:

A further embodiment of the method of cooling a die casting tip, wherein the step of using conduction cooling to cool the outer portion can include the step of transferring heat through one or more connectors connecting the outer and inner portions along the axial length of the inner portion.

A further embodiment of any of the foregoing methods of cooling a die casting tip can include the step of maintaining a temperature of each of an inner portion wall and an outer portion wall substantially near an initial cooling fluid temperature.

A further embodiment of any of the foregoing methods of cooling a die casting tip, wherein the steps of supplying the cooling fluid to the first and second portions of the plenum can include supplying cooling fluid at a velocity sufficient to produce a Reynolds number in the range of 200,000 to 1.5 million.

A further embodiment of any of the foregoing methods of cooling a die casting tip, wherein a heat transfer coefficient between the outer portion and cooling fluid supplied to the first and second portions of the plenum can be in the range of 300-2500 Btu/hour*ft$^2$*F.

A further embodiment of any of the foregoing methods of cooling a die casting tip can include the step of shielding a portion of the first closed end from direct contact with a liquid metal external to the die casting tip by disposing a tip cover on the first closed end.

A further embodiment of any of the foregoing methods of cooling a die casting tip, wherein disposing the tip cover on the first closed end can create one or more cavities between the tip cover and the closed end.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A die casting plunger tip comprising:
- a hollow outer portion comprising:
  - a first closed end;
- a hollow inner portion disposed within the outer portion and separated from the outer portion by a plenum, the inner portion having a second partially closed end having a thickness no greater than three times a thickness of the first closed end and comprising:
  - an end face separated from the first closed end of the hollow outer portion by the plenum;
  - a back face disposed opposite and parallel to the end face, the back face defining an outer boundary of a central cavity of the inner portion; and
  - an aperture extending through the partially closed end and connecting the central cavity to the plenum; and
- a plurality of first connectors integrally formed with and connecting the outer portion and the inner portion, wherein the plurality of first connectors are circumferentially spaced about an outer surface of the inner portion and wherein the plurality of first connectors extend a radial distance from the outer surface of the inner portion to an inner surface of the outer portion and extend a first axial distance along a length of the outer portion and the inner portion, the first axial distance being greater than the radial distance.

2. The die casting plunger tip of claim 1, further comprising:
- a plurality of second connectors, wherein the second connectors are disposed at an axial distance from the first connectors along the outer surface of the inner portion.

3. The die casting plunger tip of claim 1, further comprising:
- an end connector connecting the first closed end of the outer portion and the end face of the second partially closed end of the inner portion.

4. The die casting plunger tip of claim 3, wherein the end connector comprises a plurality of connector structures.

5. The die casting plunger tip of claim 3, wherein the end third connector comprises a plurality of holes.

6. The die casting plunger tip of claim 1, wherein the second partially closed end of the inner portion includes a central hole, the central hole connecting a central cavity in the inner portion with the plenum formed between the inner portion and the outer portion.

7. The die casting plunger tip of claim 1, wherein the outer portion has a wall thickness of between 1.27 mm (0.050 inches) and 4.45 mm (0.175 inches).

8. The die casting plunger tip of claim 1, wherein the outer portion has a first wall thickness at the first closed end and the inner portion has a second wall thickness at the partially closed end, the second wall thickness being substantially equal to or greater than the first wall thickness.

9. The die casting plunger tip of claim 1, wherein the outer portion and the inner portion are separated along an axial length of the tip at a first distance and between the first closed end and the second partially closed end at a second distance, the second distance being greater than the first distance.

10. The die casting plunger tip of claim 1, wherein a heat transfer coefficient between the outer portion and a cooling fluid within the plenum is in the range of 300-2500 Btu/hour*ft$^2$*F.

11. The die casting plunger tip of claim 1, further comprising:

a tip cover disposed on the first closed end of the outer portion, wherein a portion of the tip cover is separated from the first closed end, creating one or more cavities between the tip cover and the first closed end.

12. The die casting plunger tip of claim 11, wherein the outer portion further comprises:

a rim disposed along a perimeter of and extending outward from the first closed end, and wherein an inner perimeter of the rim engages an outer edge of the tip cover.

13. The die casting plunger tip of claim 2, wherein the second connectors extend a second axial distance along the length of the outer portion and the inner portion, the second axial distance being less than the first axial distance.

14. A method of cooling a die casting tip, the method comprising the steps of:

using convection cooling to cool walls of a double-walled die casting tip, the use of convection cooling comprising the steps of:

supplying a cooling fluid to a central cavity of a hollow inner portion;

supplying the cooling fluid to a back face of a partially closed end of the hollow inner portion, wherein the back face is disposed opposite and parallel to an end face of the hollow inner portion;

supplying the cooling fluid to a first portion of a plenum located between a first closed end of a hollow outer portion and the end face of the second partially closed end of the inner portion, the second partially closed end having an aperture connecting the central cavity to the first portion of the plenum, wherein the second partially closed end has a thickness that is no greater than three times a thickness of the first closed end; and supplying the cooling fluid to a second portion of the plenum located between the outer portion and the inner portion along an axial length of the inner portion; and using conduction cooling to cool the outer portion, the use of conduction cooling comprising the step of:

transferring heat through a plurality of first connectors integrally formed with and connecting the outer and inner portions, wherein the plurality of first connectors are circumferentially spaced about an outer surface of the inner portion and wherein the plurality of first connectors extend a radial distance from the outer surface of the inner portion to an inner surface of the outer portion and extend a first axial distance along a length of the outer portion and the inner portion, the first axial distance being greater than the radial distance.

15. The method of claim 14, wherein the step of using conduction cooling to cool the outer portion further comprises the step of:

transferring heat through a third connector connecting the first closed end and the second partially closed end.

16. The method of claim 14, further comprising the step of:

maintaining a temperature of each of an inner portion wall and an outer portion wall substantially near an initial cooling fluid temperature.

17. The method of claim 14, wherein the steps of supplying the cooling fluid to the first and second portions of the plenum comprises supplying cooling fluid at a velocity sufficient to produce a Reynolds number in the range of 200,000 to 1.5 million.

18. The method of claim 14, wherein a heat transfer coefficient between the outer portion and cooling fluid supplied to the first and second portions of the plenum is in the range of 300-2500 Btu/hour*ft$^2$*F.

19. The method of claim 14, further comprising the step of shielding a portion of the first closed end from direct contact with a liquid metal external to the die casting tip by disposing a tip cover on the first closed end.

20. The method claim of 19, wherein disposing the tip cover on the first end creates one or more cavities between the tip cover and the first closed end.

* * * * *